US006646647B1

(12) United States Patent
Surgutchik et al.

(10) Patent No.: US 6,646,647 B1
(45) Date of Patent: Nov. 11, 2003

(54) DISPLAY OF IMAGES FROM TILED MEMORY

(75) Inventors: Roman Surgutchik, Karkur (IL); Gad S Shaeffer, Haifa (IL); Oded Lempel, Haifa (IL); Robert Valentine, Qiryat Tivon (IL)

(73) Assignee: Intel Corporation, Santa Clara, CA (US)

( * ) Notice: Subject to any disclaimer, the term of this patent is extended or adjusted under 35 U.S.C. 154(b) by 383 days.

(21) Appl. No.: 09/672,453

(22) Filed: Sep. 29, 2000

(51) Int. Cl.[7] ..... G09G 5/36

(52) U.S. Cl. ..... 345/581; 345/545; 345/539

(58) Field of Search ..... 345/501–506, 345/519–520, 522, 530–574, 534, 581, 560, 606, 619, 629, 204, 694

(56) References Cited

U.S. PATENT DOCUMENTS

| | | | | | |
|---|---|---|---|---|---|
| 4,203,102 | A | * | 5/1980 | Hydes | 345/467 |
| 4,742,350 | A | * | 5/1988 | Ko et al. | 345/539 |
| 5,257,348 | A | * | 10/1993 | Roskowski et al. | 345/546 |
| 5,394,523 | A | * | 2/1995 | Harris | 395/162 |
| 5,784,116 | A | * | 7/1998 | Pan et al. | 348/453 |
| 5,815,168 | A | * | 9/1998 | May | 345/572 |
| 6,166,772 | A | * | 12/2000 | Voltz et al. | 348/448 |
| 2003/0058221 | A1 | * | 3/2003 | Tucker et al. | 345/163 |

* cited by examiner

*Primary Examiner*—Kee M. Tung
(74) *Attorney, Agent, or Firm*—Kenyon & Kenyon

(57) ABSTRACT

Embodiments of the present invention relate to displaying images from memory. A plurality of pixel attributes are retrieved from memory in a single memory transaction. At least one attribute corresponds to one scan line of a display and another attribute corresponds to another scan line of the display. A portion of one scan line using the corresponding pixel attribute is displayed. The pixel attributes corresponding to another scan line is stored in a buffer.

29 Claims, 7 Drawing Sheets

DISPLAY OF IMAGES FROM TILED MEMORY

FIELD OF THE INVENTION

Embodiments of the present invention pertain to the field of displaying images. More particularly, the present invention relates to display of images from a tiled memory.

BACKGROUND OF THE INVENTION

Providing high-quality images is a feature that is very popular in many devices. For example, many computers include cathode ray tube (CRTs) displays, liquid crystal displays (LCDs), light emitting polymer displays (LEPs), or organic or inorganic light emitting diode displays (LEDs). Typically, the displays are divided into thousands (or millions) of picture elements (pixels), arranged in rows and columns (i.e., scan lines). The pixels are so close together that they appear connected. Each pixel or a group of pixels may have one or more pixel attributes defining the characteristics of the pixel stored in a memory.

Conventional graphics systems use paged memory structures to store these pixel attributes relating to scan lines of the display. These conventional systems perform their data operations by traversing a first scan line of displayed pixels, then advancing to a second scan line of displayed pixels using the corresponding stored pixel attributes in the paged memory. The operation advances iteratively, scan line by scan line, until the entire screen is displayed.

Some modem graphics systems can organize a display screen and corresponding memory according to tiled memory techniques for reasons of 3-Dimensional (3-D) accelerator performance, as shown in FIGS. 1*a* and 1*b*, respectively.

FIG. 1*a* illustrates a display screen 100 having pixels that are divided, for example, among fifteen tiles 101–115. FIG. 1*b* illustrates a corresponding memory 120 that stores pixel attributes W0–W35 (e.g., words) associated with the pixels of tile 101. For simplicity, only some of the pixel attributes are shown in FIG. 1*b*. More specifically, pixel attributes for columns 0, 1 and 5 of tile 101 are shown. Representations similar to the one shown for tile 101 in FIG. 1*b*, can be made for the other tiles in FIG. 1*a*. Pixel attributes W0–W35 are sequentially stored in memory 120 in consecutive memory address locations 0–35. While memory 120 stores pixel attributes W0–W35 with a vertically tiled organization, pixel attributes associated with the pixels of a tile can be organized in memory as either horizontal tiles or vertical tiles. Attributes organized as vertical tiles means that pixel attributes of adjacent pixels on a vertical line of the display are in consecutive locations in memory. Attributes organized as horizontal tiles means that pixel attributes of adjacent pixels on a horizontal line of the display are in consecutive locations in memory.

As shown in FIG. 1*b*, pixel attribute W0 and pixel attribute W1 are sequentially stored in consecutive memory address locations 0 and 1, in memory 120, and contain the information needed to control the pixels of column 0, row 0, and column 0, row 1, respectively. Similarly, pixel attribute W5 and pixel attribute W6 are sequentially stored in consecutive memory address locations 5 and 6, in memory 120, and contain the information needed to control the pixels of column 0, row 5, and column 1, row 0, respectively.

Organization of the pixel attributes into vertical tiles or horizontal tiles results in two consecutive pixel attributes being associated with two different rows or horizontal lines of a display screen. Thus, accessing two or more pixel attributes from consecutive memory locations that are associated with two different lines of a display screen can be inefficient. For example, when a horizontal scan line is displayed, the pixel attribute associated with the current scan line being displayed will be used while the pixel attribute associated with the next scan line will be discarded. The discarded attributed will be re-fetched from memory when the scan line with which the pixel attribute is associated is actually displayed. This doubles the required bandwidth of the display stream.

More specifically, for example, when drawing the first horizontal scan line of display 100, pixel attributes W0 and W1 are retrieved from memory 120, if memory 120 has a granularity of two words. Pixel attribute W0 is used to display the pixel at column 0, row 0, and pixel attribute W1 is discarded since it is related to the second horizontal scan line. Next, pixel attributes W6 and W7 are retrieved from memory 120. Pixel attribute W6 is used to display the pixel at column 1, row 0, and pixel attribute W7 is discarded. This process continues until the first horizontal scan line has been completed. When drawing the second horizontal scan line of display 100, pixel attributes W0 and W1 are again retrieved from memory 120. However, in this case, pixel attribute W1 is used to display the pixel at column 0, row 1, and pixel attribute W0 is discarded. This process of retrieving the same two attributes twice and only displaying a pixel using one of the attributes is inefficient. While the inefficiency has been described for a memory having vertical tiling, the inefficiency would also occur when there is tiling having a first display orientation and a display engine that uses scanning for display in another orientation.

BRIEF DESCRIPTION OF THE DRAWINGS

Embodiments of the present invention are illustrated by way of example, and not limitation, in the figures of the accompanying drawings in which like references denote similar elements, and in which.

DETAILED DESCRIPTION

In an embodiment, two pixel attributes stored in consecutive memory locations may be retrieved from a tiled memory in a single memory transaction. One of the pixel attributes may be used to display a portion of a first scan line of the display, and the second pixel attribute may be temporarily stored in a buffer. Another pair of pixel attributes, stored in consecutive memory locations, may be retrieved. Again, one of the pixel attributes may be used to display a portion of the first scan line while the second pixel attribute may be stored in the buffer. This process may continue until the first scan line has been completed. After the first scan line has been displayed, the plurality of pixel attributes stored in the buffer may be retrieved and used to display another scan line. Accordingly, embodiments of the present invention advantageously utilize memory bandwidth, thus, reducing inefficiencies encountered with known methods.

Figure 1A:
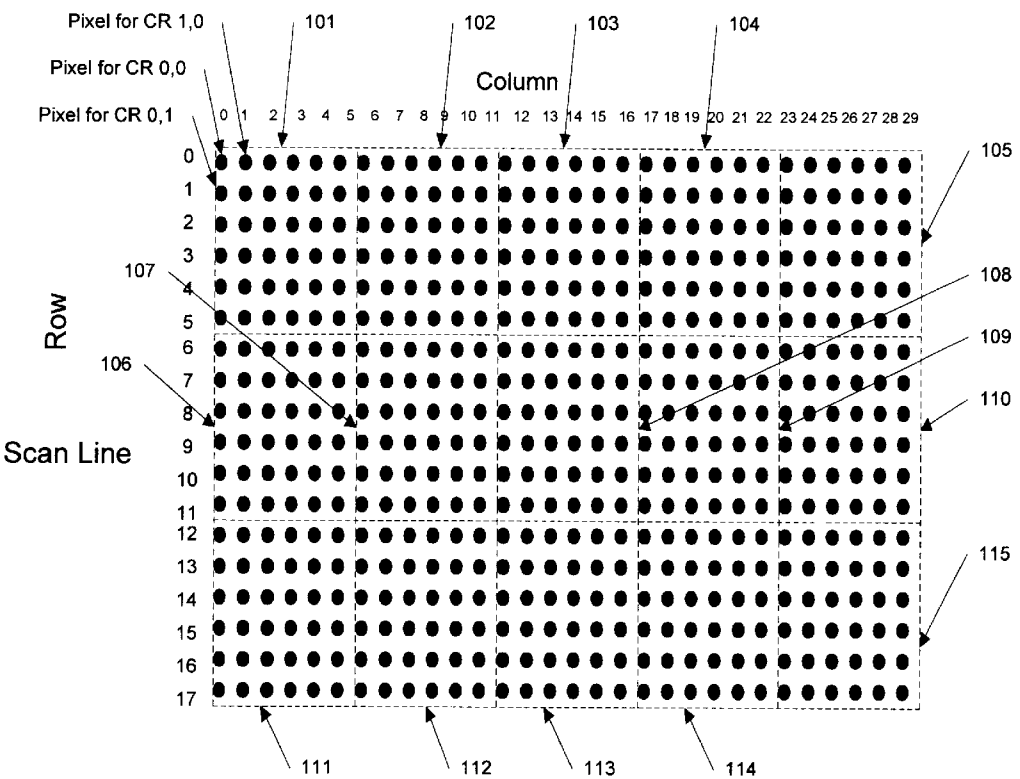
FIG. 1*a* shows a display screen divided into a plurality of tiles.
Figure 1B:
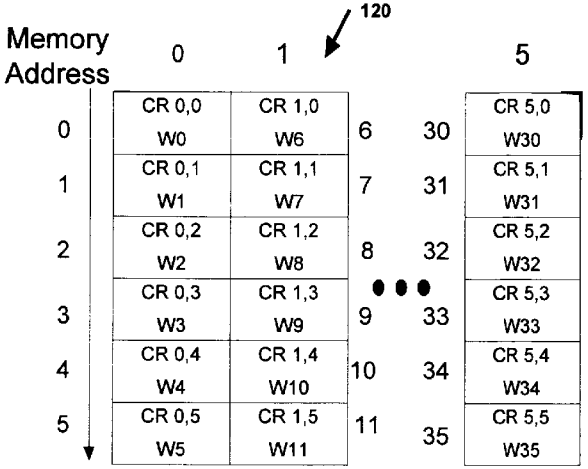
FIG. 1*b* shows a memory that stores pixel attributes stored with a vertical tile organization.
Figure 2:
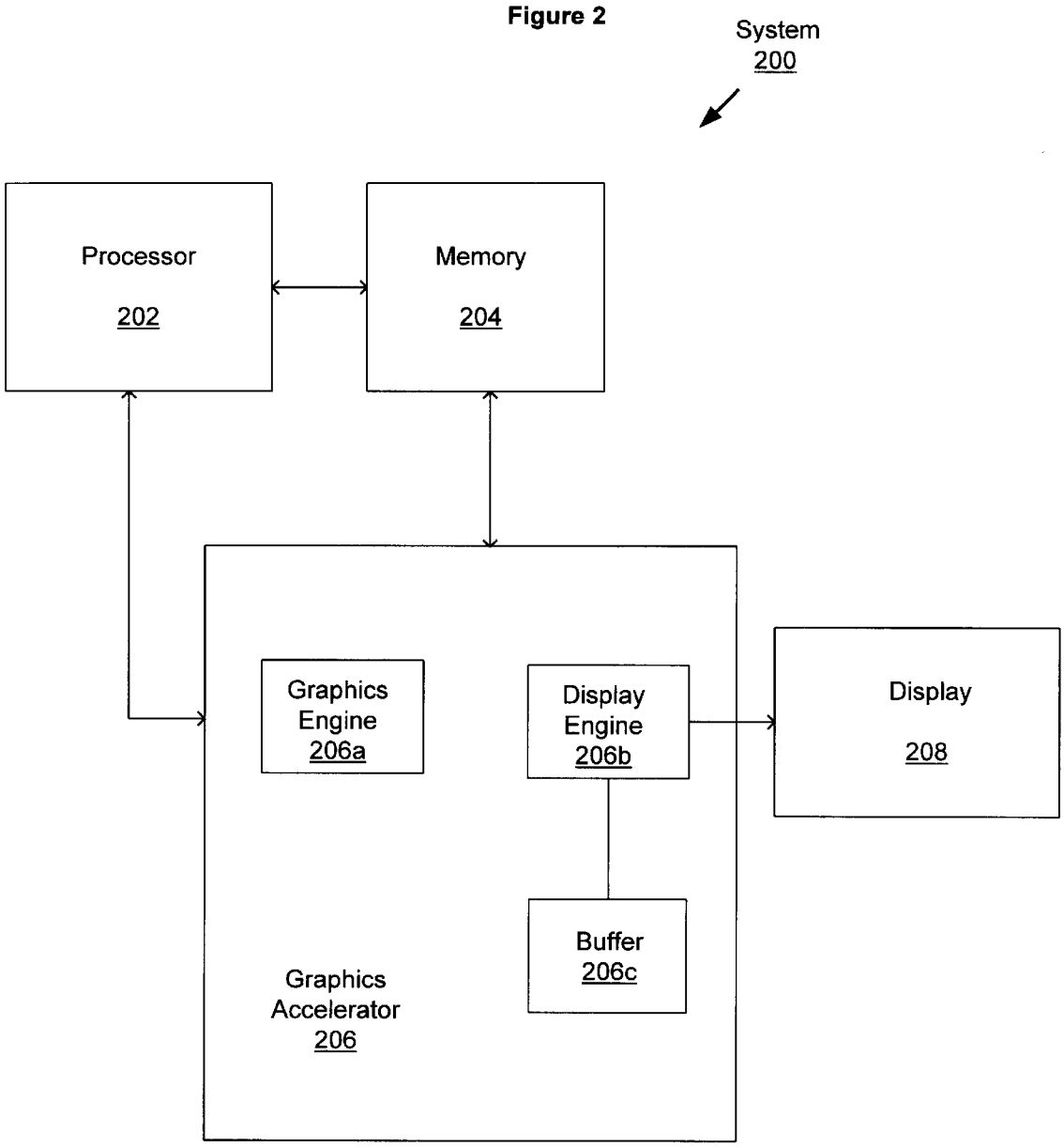
FIG. 2 shows a block diagram of a display system 200 according to an exemplary embodiment of the present invention.

FIG. 2 shows a block diagram of a display system 200 according to an embodiment of the present invention. Display system 200 may find applications for use in a computer system, server, or any of a variety of set-top boxes, entertainment systems, video game machines, or embedded systems. System 200 may include a processor 202 coupled to memory 204 and graphics accelerator 206. Graphics accelerator 206 may be further coupled to display screen 208. To display images on display screen 208, processor 202 and/or graphics accelerator 206 under the control of a program performs calculations to generate display information that is stored in memory 204. The stored information may be retrieved and utilized to drive appropriate circuitry and/or components of display 208. The term "coupled" may refer to direct coupling or indirect coupling through another device.

Examples of display 208 include, but are not limited to, CRT displays or monitors, LCDs, LEPs, or LEDs, and/or other suitable displays. A typical display is divided into multiple picture elements (e.g., pixels) that may be individually displayed based on the display information. The display information may include one or more pixel attributes that may be stored and retrieved from memory 204. Each of the pixel attributes may include data needed to control the color and brightness, among other qualities, of one or more associated pixels. Pixel attributes may be used to individually turn on a pixel (or a group of pixels) and give them a certain color and/or brightness. By turning on multiple pixels, each of which has its own color and brightness, images appear on the screen.

In graphics accelerators that support 3-D images, objects or surfaces are approximated as connected polygons, usually triangles. Greater detail can be obtained by using a larger number of smaller triangles to approximate the object or surface. The image displayed on the computer's display screen is generated from pixel attributes that may determine the position, color, lighting, and texture of the triangles. An application program (e.g., a game, simulation or animation software) running on a processor in a device may specify the position of the three vertices of a triangle and the color, depth and texture attributes of each vertex. The color, depth, and texture attributes of the vertices are distributed as pixels (image pixel attributes) within the triangle by a rasterizing process performed by a processor or by a graphics accelerator (or graphics co-processor).

Memory 204 may store a program having instructions. The instructions may be retrieved from memory 204 by processor 202. Processor 202 executes the instructions and generates information that graphics accelerator 206 can use to create and display images.

Graphics accelerator 206 may include, for example, graphics engine 206*a*, display engine 206*b* and buffer 206*c*. Graphics engine 206*a* may generate pixel attributes for the graphics accelerator 206. Graphics engine 206*a* may perform the rasterizing process by, for example, calculating the color, depth, and texture attributes of pixels (collectively referred to as image pixel attributes) within the triangle. The image pixel attributes may be stored in memory 204 in a tiled orientation. Graphics accelerators supporting 3-D graphics, for example, can benefit from such tiled memory orientation, especially vertical tiling.

Based on instructions from processor 202, graphics engine 206*a* may create pixel attributes for the plurality of pixels used to create images on a display screen. Display engine 206*b* may utilize the pixel attributes to generates signals for driving display 208. The signals may be, for example, RGB (red, green, blue) signals, signals for driving a LCD or yet other types of suitable signals that are dependent upon the type of screen and the display mode (e.g., resolution or number of colors) of the screen.

In embodiments of the invention, buffer 206*c* may be coupled to display engine 206*b* and may be used for storage of pixel attributes as will be described below in more detail. Buffer 206*c* may have sufficient size to store pixel attributes associated with at least a single scan line of the display on chip. In alternative embodiments of the invention, buffer 206*c* may have sufficient capacity to store pixel attributes associated with a plurality of scan lines. Alternatively, more than one buffer may be utilized to store pixel attributes in accordance with embodiments of the invention. In alternative embodiments, buffer 206*c* may be incorporated within display engine 206*b*.

Figure 3A:
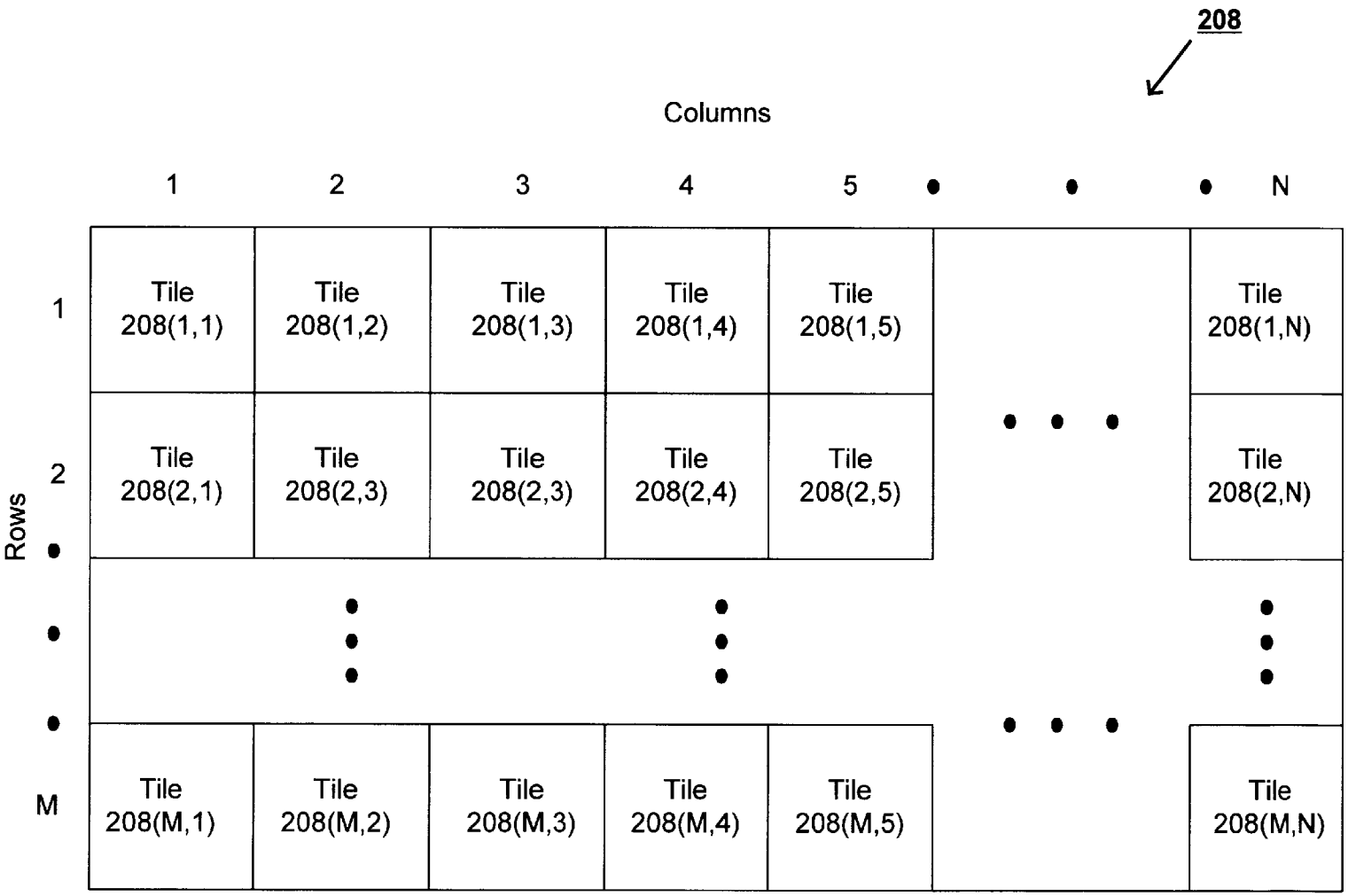
FIG. 3*a* is a diagrammatic representation of a display according to an exemplary embodiment of the present invention.

FIG. 3*a* is a diagrammatic representation of display 208, in greater detail, according to an embodiment of the present invention. For example, display 208 includes a plurality of pixels (not shown) that may be divided into a plurality of tiles organized into horizontal rows 208_1–208_M and vertical columns 208_1–208_N where M represents a maximum number of horizontal rows and N represents a maximum number of vertical columns. Accordingly, display 208 may be divided into tiles 208(1,1) to 208(M,N). While in one embodiment M equals 32 (i.e., display 208 has tiles organized into 32 horizontal rows) and N equals 64 (i.e., display 208 has tiles organized into 64 vertical columns), it is recognized that alternative embodiments can have different numbers of rows and/or columns of tiles. Individual tiles in FIG. 3*a* are referred to by the following format, tile 208(row, column).

Figure 3B:
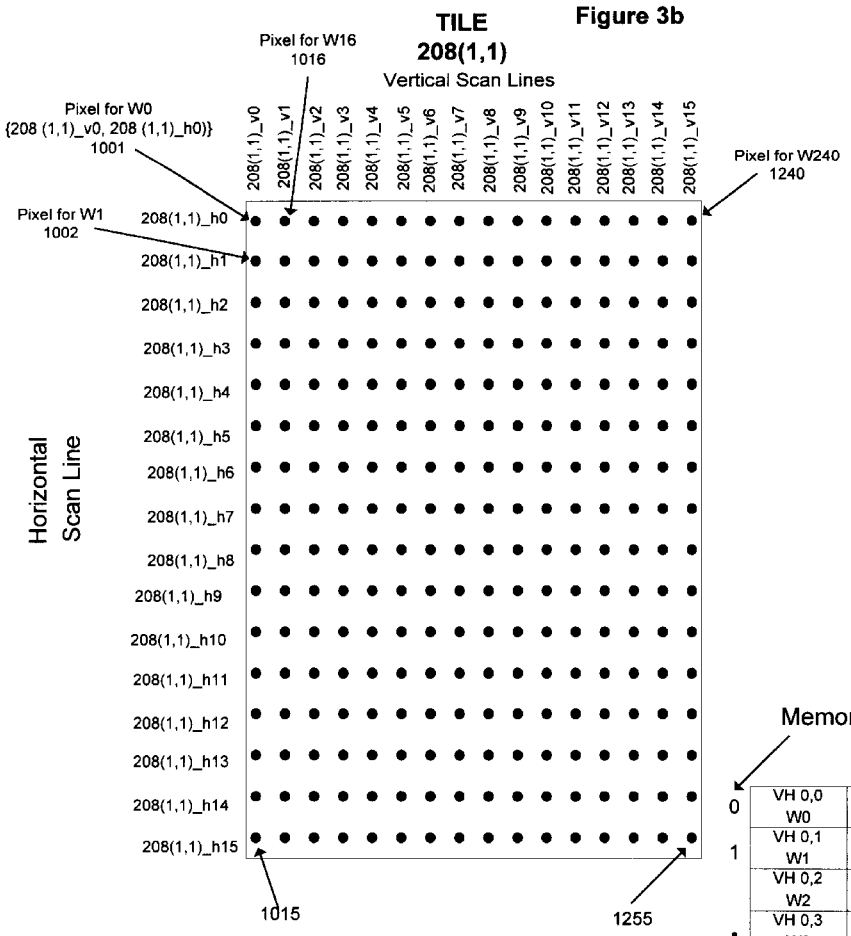
FIG. 3*b* is a diagrammatic representation of a tile of the display as shown in FIG. 3*a*, in accordance with embodiments of the present invention.

FIG. 3*b* shows, in greater detail, tile 208(1,1) of display 208 as shown in FIG. 3*a*, according to an embodiment. Tile 208(1,1) may include, for example, 256 pixels (marked by dark circles and labeled as 1001 to 1255) which are divided into 16 vertical scan lines (v0 to v15) and 16 horizontal scan lines (h0 to h15). Display engine 206*b* may display pixels for each scan line starting with scan line 208(1,1 )_h0. In an embodiment,when engine 206*b* completes displaying pixels for scan line 208(1,1)_h0, engine 206*b* may display pixels for the first scan line of tile 208(1,2) and then, of the other tiles in row 208_1 of FIG. 3*a*. When engine 206*b* is finished displaying the pixels for the first scan line of the tiles in row 208_1 of FIG. 3*a*, engine 206*b* may display pixels for scan line 2 for all of the tiles in row 208_1 (i.e., up to tile 208 (1,N)) of FIG. 3*a*. This process may continue until engine 206*b* completes displaying the pixels for the last scan line (i.e., scan line 16) of tile 208(M, N), engine 206*b* returns to scan line 208(1,1)_h0 of tile 208(1,1) and displays the pixels for scan line 208(1,1)_h0 again. It is recognized that the tiles and/or the included pixels may be displayed in any suitable manner or order.

In an embodiment, to display pixels for a particular scan line, display engine 206*b* may receive pixel attributes associated with the pixels for the desired scan line from memory 204. The pixel attributes are stored in memory 204 having a first display orientation (e.g., vertical tiling, horizontal tiling or other orientation). As described above, attributes organized as vertical tiles means that pixel attributes of adjacent pixels on a vertical line of the display are in consecutive locations in memory. Attributes organized as horizontal tiles means that pixel attributes of adjacent pixels on a horizontal line of the display are in consecutive locations in memory.

Figure 3C:
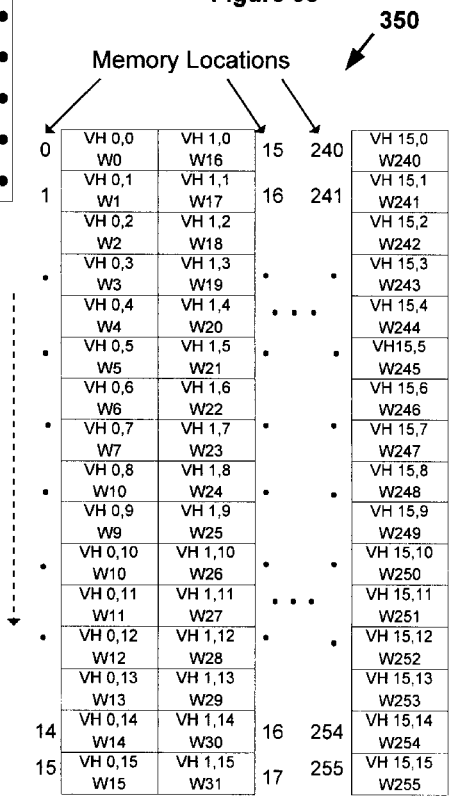
FIG. 3*c* illustrates pixel attributes organized as a vertical tile in memory related to the exemplary tile shown in FIG. 3*b*.

FIG. 3*c* illustrates a memory section 350 of memory 204. Memory section 350 may store pixel attributes W0–W255 (e.g., words) having, for example, a vertical tiling orientation. In this example, memory section 350 includes 256 words (W0–W255). Each word (e.g., W0) may represent a pixel attribute relating to or describing a single pixel located in, for example, tile 208(1,1) of display 208. It is recognized that a pixel attribute may relate to more than one pixel, or a plurality of pixel attributes may relate to one or more pixels of the tiles or combination of tiles. For illustration, W0, W2, W4, etc. are referred to herein as even pixel attributes associated with even scan lines h0, h2, h4, etc., respectively (or v0, v2, v4, etc., respectively), while W1, W3, W5, etc. are referred to herein as odd pixel attributes associated with odd scan lines h1, h3, h5, etc., respectively (or v1, v3, v5, etc., respectively).

As shown, pixel attributes, for example, W0–W255 may be located in consecutive memory locations 0–255 in section 350 of memory 204. For illustration purposes, pixel attribute W0 located in memory location 0 may be related to pixel 1001 on the first horizontal scan line (i.e., 208(1, 1)_h0), of tile 208(1,1) having the coordinates {208(1,1)_v0, 208(1, 1)_h0}, as shown in FIG. 3*b*. In this memory configuration, the next consecutive memory location of memory section 350, for example, location 1 contains pixel attribute W1 that may be related to pixel 1002 on the second horizontal scan line (i.e., 208(1,1)_h1) having the coordinates {208(1,1)_v0, 208(1,1)_h1}. The next adjacent pixel on the horizontal scan line (i.e., pixel 1016) of the first horizontal scan line (i.e., 208(1,1)_h0)) may have its corresponding pixel attribute (W16) stored in memory location 16 of memory section 350. The remaining pixel attributes relate to one or more of the remaining pixels. Pixel attributes (e.g., words) for the first column(v0), second column (v1), and sixteenth column (v15) columns are shown in FIG. 3*c*. However, it should be appreciated that the columns not shown can be similarly represented. Although memory 204 is vertically tiled, it is recognized that alternative embodiments of the invention may include tiles organized in different orientations, e.g., horizontal tiling.

While in one embodiment, each pixel attribute is one word (two bytes) and the memory system may have an access granularity of a double word, it should be appreciated that for alternative embodiments, pixel attributes and/or access granularity can be shorter or longer (e.g., quadwords and double quadwords, respectively). Thus, display engine 206*b* having, for example, an access granularity of a double word, receives two pixel attributes (e.g., W0 and W1). As indicated above, one attribute may be associated with one scan line and the other attribute may be associated with another scan line. In embodiments of the present invention, access granularity of the memory may be in multi-word units such as quadwords (i.e., access granularity of eight (8) bytes) or double quadwords (i.e., access granularity of sixteen (16) bytes).

Embodiments of the present invention may be used for processing data words of unspecified physical size containing unspecified number of horizontally adjacent pixels, thus all different word lengths (data formats of varying size) fall within the scope of embodiments of the present invention.

It is to be noted that 'pixel' as used herein may refer to one pixel or a group of pixels (i.e., more than one. In some cases, a group of pixels may have common characteristics and/or attributes. Accordingly, it is recognized that a single pixel attribute may be associated with more than one pixel.

Figure 4:
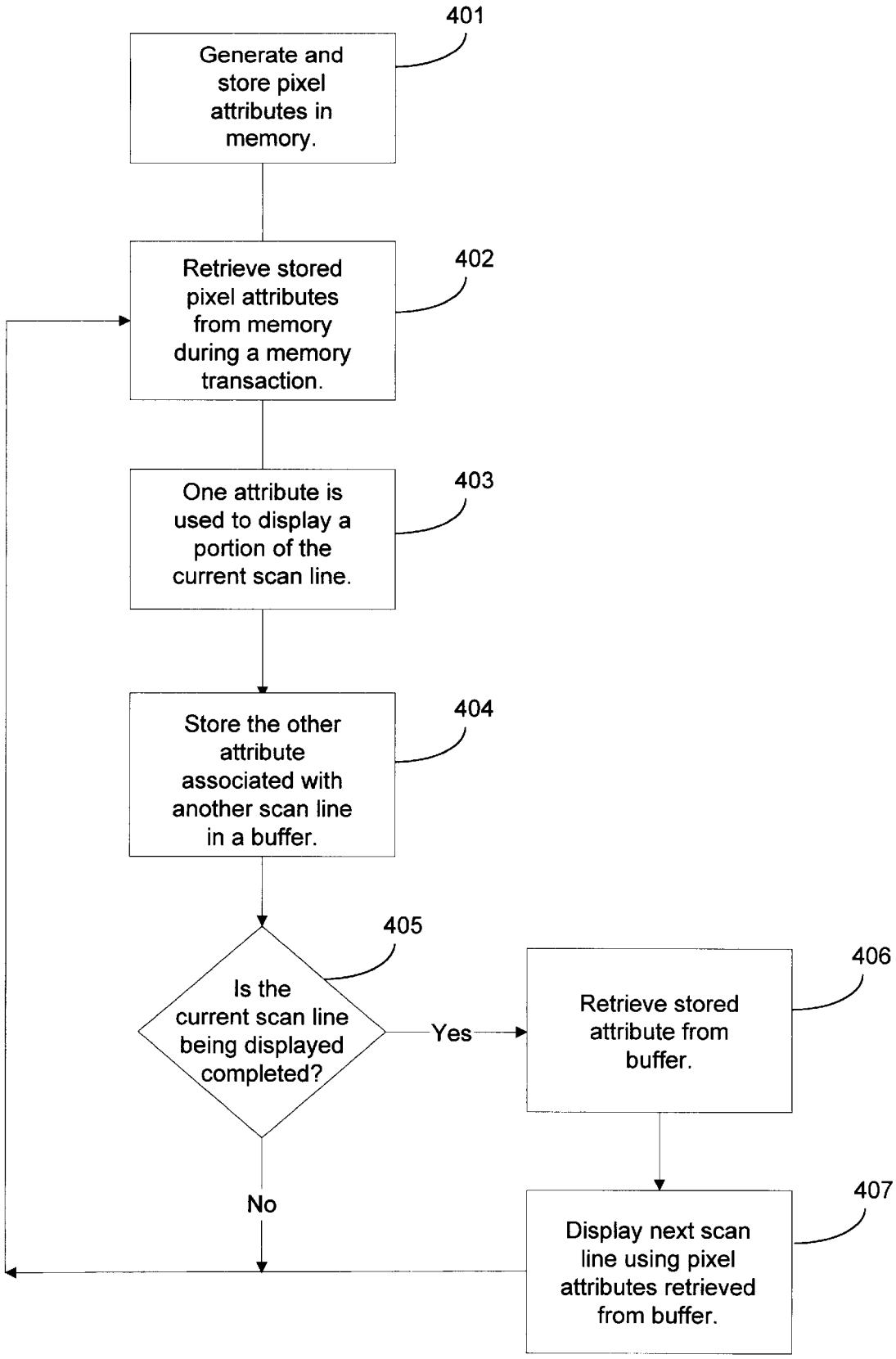
FIG. 4 is a flow chart relating to the operation of an embodiment of the present invention.

FIG. 4 is a flow chart describing an exemplary operation in accordance with embodiments of the invention. Graphics engine 206*a* may receive information from processor 202 to create images and store generated pixel attributes in memory 204, as shown in step 401. The pixel attributes may be stored in memory 204 using a first display orientation (e.g., vertical tiling, horizontal tiling, etc). During a memory transaction, display engine 206*b* retrieves the stored pixel attributes from memory 204, as shown in step 402. Display engine 206*b* may retrieve two pixel attributes (which, in this example, includes a pixel attribute size of one word while having an access granularity of two words), a first pixel attribute and a second pixel attribute, in a single memory access transaction.

In an embodiment, where pixel attributes may be stored as vertical tiles, display engine 206*b* may retrieve a pair of pixel attributes (e.g., the first and second pixels) that are located in consecutive memory locations in memory 204. In this case, the two pixel attributes may be associated with two different scan lines. As shown in step 403, one of the pixel attributes may be used to display a pixel or a portion (i.e., a group of pixels) of the current scan line being displayed (e.g., the current horizontal scan line). The other pixel attribute, associated with another scan line, may be stored in buffer 206*c*, as shown in step 404.

In embodiments of the invention, the first pixel attribute may be an even pixel attribute (e.g., W0) that may be associated with a pixel on an even horizontal scan line (e.g., h0 or v0). The second pixel attribute may be an odd pixel attribute (e.g., W1) that may be associated with a pixel on an odd horizontal scan line (e.g., h1 or v1) which may be displayed after the scan line currently being displayed by display engine 206*b* is completed.

As shown in step 405, it is determined whether the current scan line being displayed has been completed. If the current scan line being displayed has not been completed, then, for example, display engine 206*b* may revert back to step 402 to retrieve another pair of pixel attributes (e.g., third pixel attribute and fourth pixel attribute) from memory, as shown in step 402. Again, from the next pair of pixel attributes retrieved (e.g., the third and fourth pixels), one of the attributes may be used to display a second pixel (or another group of pixels) on the scan line currently being displayed and the other pixel, associated with another scan line, may be stored in a buffer, as shown in steps 403 and 404. Accordingly, steps 402 through 404 may be repeated until the current scan line being displayed has been completed.

As shown in step 405, if it is determined that the current scan line being displayed has been completed, then the memory attributes stored in buffer 206*c* may be retrieved, as shown in step 406. As shown in step 407, the retrieved attributes may be used to display the next scan line (i.e., the scan line associated with the attributes stored in the buffer 206*c*). Once the next scan line has been displayed, display engine 206*b*, for example, may revert back to step 402 and retrieve stored pixel attributes from memory 204 and continue the above described process for displaying, for example, the next pair of scan lines to completely display an image on display 208.

Referring again to FIGS. 3*b*–3*c*, to display the pixel for horizontal scan line 208(1,1)_h0 and vertical line 208(1, 1)_v0, display engine 206*b* retrieves attribute W0 and attribute W1 from memory 204 (where attribute W0 and W1 are located in consecutive memory locations, as shown in FIG. 3*c*). Display engine 206*b* may display the pixel having the coordinates of 208(1,1)_h0 and 208(1,1)_v0, using even attribute W0, and stores odd attribute W1 in buffer 206*c*. To display the next pixel for line 208(1,l) h0 (i.e., having the coordinates of 208(1,1)_h0 and 208(1,1)_v1), display engine 206*b* may retrieve even attribute W16, and odd attribute W17 from memory 204 (where attribute W 16 and W 17 are located in consecutive memory locations, as shown in FIG. 3*c*). Display engine 206*b* may display the second pixel having the coordinates of 208(1,1)_h0 and 208(1,1)_v1, using attribute W16, and store attribute W17 in buffer 206*c*.

Display engine 206*b* may continue to retrieve two attributes from memory 208 and use, for example, the even attributes to display the current scan line and temporarily store the odd attributes in buffer 206*c* until pixels for horizontal scan line 208(1,1)_h0 have been displayed. When display engine 206*b* has completed displaying pixels for horizontal scan line 208(1,1)_h0, display engine 206*b* may display pixels for horizontal line 208(1,1)_h1. Advantageously, display engine 206*b* can retrieve the plurality of odd pixel attributes, previously stored in the buffer 206*c* by the display engine 206*b*, to display the next scan line from buffer 206*c*. For example, to display the first pixel for line 208(1,1)_h1, display engine 206*b* may retrieve W1 from buffer 206*c* instead of memory 204. Display engine 206*b* may also retrieve the remaining odd attributes associated with the pixels on line 208(1,1)_h1, such as attribute W17, from buffer 206*c*. The pixel attributes for the remaining scan lines for display 208 may be retrieved and pixels may be displayed in the manner described above.

While in the above description, display engine 206*b* displays pixels starting on, for example, an even scan line (e.g., 208(1,l) h0) and ending on an odd scan line (e.g., 208(M, N)_h15), it is possible, due to centering and panning, for display engine 206*b* to display screens starting on an odd scan line (e.g., 208(1,1)_h1 and/or to end on an even scan line (e.g., 208(2,N),_h12).

Figure 5:
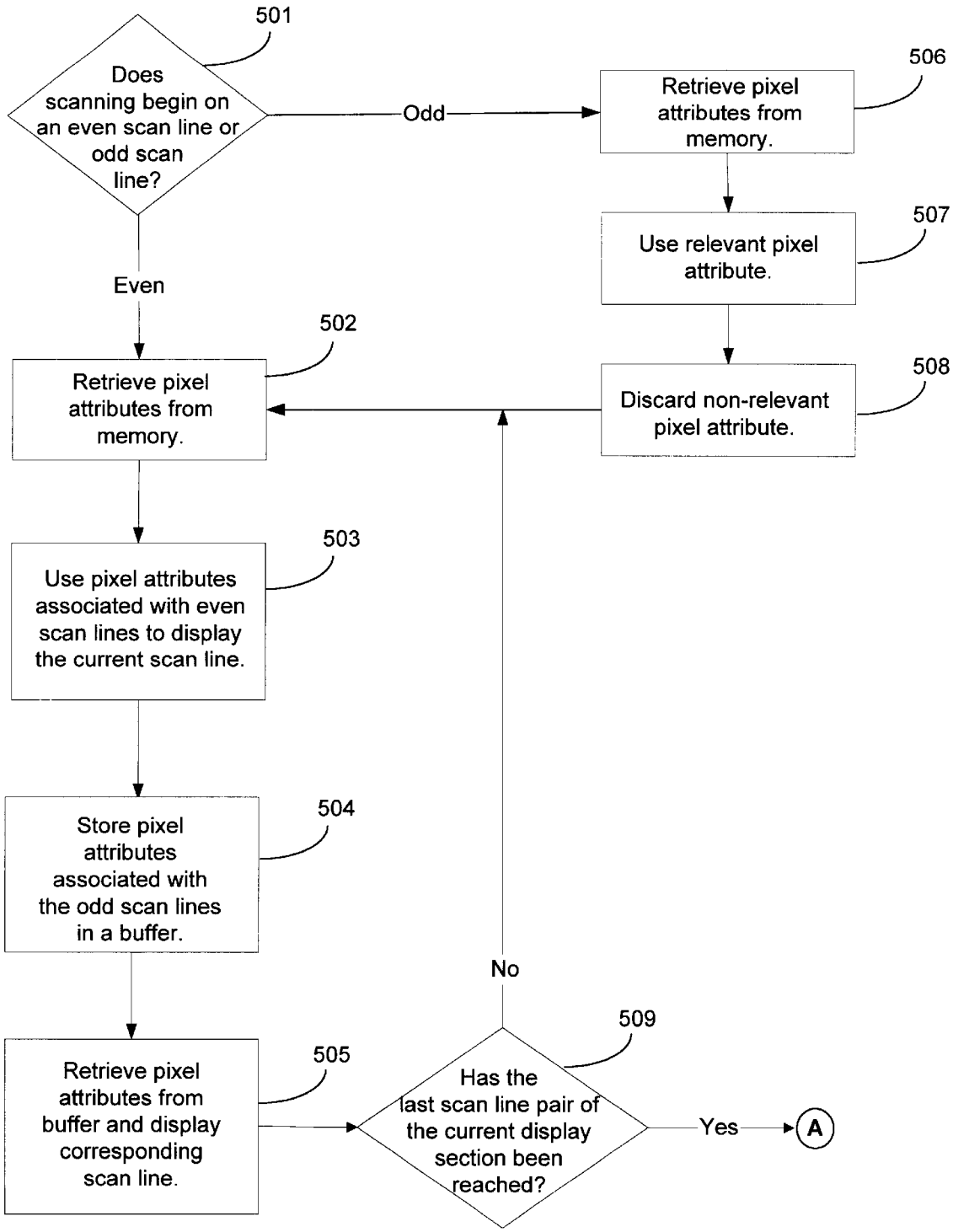
FIG. 5 is a flow chart relating to the operation of an embodiment of the present invention.
Figure 6:
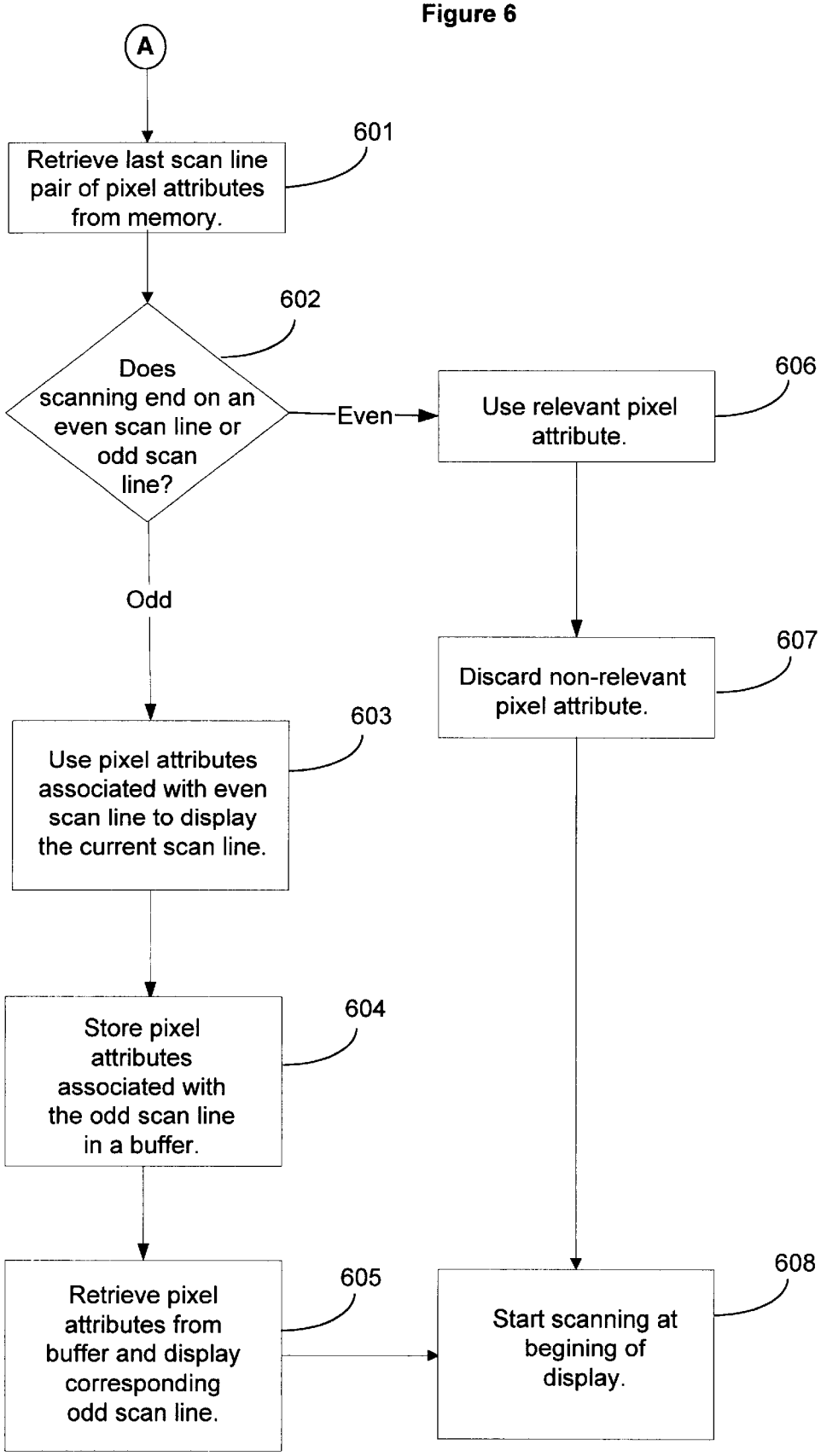
FIG. 6 is a flow chart relating to the operation of an embodiment of the present invention.

Flow charts shown in FIGS. 5 and 6 describe an exemplary operation in accordance with embodiments of the invention. As shown in step 501, processor 202 or display engine 206*b* may determine whether scanning (displaying) begins on an even scan line or an odd scan line. If it is determined that scanning is beginning on, for example, an odd scan line, a pair of pixel attributes may be retrieved from primary memory 204, as shown in steps 501 and 506. In this case, the relevant pixel attributes (e.g., the pixel attributes related to the odd scan line) may be used to display the odd scan line, as shown in step 507. The non-relevant pixel attributes (e.g., the pixel attributes related to the even scan line) may be discarded and not stored in the buffer 206*c*, as shown in step 507. Once the odd scan line is completed, additional pixel attributes may be retrieved and the process may continue normal operation using the buffer, as shown in steps 502 through 505 to display the image. Accordingly, steps 506 through 508 may be used to re-synchronize the system so that advantages of the present invention may be realized using the buffer 206*c*.

If it is determined that scanning is beginning on, for example, an even scan line or after the re-synchronization process of steps 506–508 has been completed, the next pair of pixel attributes may be retrieved from primary memory 204, as shown in step 502. As shown in step 503, pixel attributes associated with the even scan line may be used to display the current scan line. As shown in step 504, pixel attributes associated with the odd scan line may be stored in buffer 206*c*. After the even scan line has been displayed, the pixel attributes stored in the buffer may be retrieved and used to display the corresponding odd scan line, as shown in step 505.

As shown in step 509, if display engine has not reached pixel attributes for the last scan line pair to be displayed, the normal process for retrieving and displaying pixel attributes continues, as shown in steps 502–505.

If the display engine has reached the pixel attributes for the last scan line pair to be displayed, then as shown in step 601 of FIG. 6, the last scan line pair of pixel attributes may be retrieved from memory. Scanning may end on an odd scan line because the display section of interest may end on an odd scan line, thus, the remainder of the display may not be shown.

If it is determined that scanning ends on an even scan line, the relevant pixel attributes (e.g., the pixel attributes related to the even scan line) may be used to display the even scan line, as shown in steps 602 and 606. The non-relevant pixel attributes (e.g., the pixel attributes related to the odd scan line) may be discarded and not stored in the buffer 206*c*, as shown in step 607. Once the last scan line (e.g., even scan line) of the display section of interest has been displayed and the non-relevant pixel attribute has been discarded, scanning may again start at the beginning of the display, as shown in step 608.

If it is determined that scanning ends on an odd scan line, pixel attributes associated with the even scan line may be used to display the current scan line, as shown in steps 602 and 603. As shown in step 604, pixel attributes associated with the odd scan line (i.e., last scan line) may be stored in buffer 206*c*. After the even scan line has been displayed, the pixel attributes stored in the buffer may be retrieved and used to display the corresponding odd scan line, as shown in step 605. Once the last scan line (e.g., odd scan line) of the display section of interest has been displayed, scanning may again start at the beginning of the display, as shown in step 608.

The invention has been described with particular reference to memory that has a first display orientation (e.g., memory organized as vertical tiles) and a display system that utilizes a first direction for displaying scan lines (e.g., horizontal scanning). It is recognized that embodiments of the present invention can be utilized in display systems that utilize another display orientation (e.g., memory organized as horizontal tiles) and/or utilize a second direction for displaying scan lines (e.g., vertical scanning). Vertical tiling may be advantageous for some rasterizing algorithms where the rasterizing process may take up less memory bandwidth when the memory has a vertical tile organization.

It is a byproduct of the invention that, when all attribute information of an even scan line is displayed by the display engine, all attribute information of an odd line will be waiting in the buffer ready to be displayed. It is possible that the odd scan line could be displayed without requiring a main memory access. This is a further advantage because the attributes relating to the scan line are temporarily stored in the buffer.

In the above description, for purposes of explanation, numerous specific details have been set forth in order to provide a thorough understanding of embodiments of the present invention. It will be evident, however, to one skilled in the art that embodiments of the present invention may be practiced in a variety of display systems, especially personal computers, without these specific details. In other instances well known operations, steps, functions and devices are not shown in order to avoid obscuring the invention.

The above description has been presented using terminology commonly employed by those skilled in the art to convey the substance of their work to others skilled in the art, such as processor, graphics accelerator, display or screen, and memory, and so forth. Also, parts of the description have also been presented in terms of operations performed through the execution of programming instructions or initiating the functionality of some electrical component (s) or circuitry, using terms such as, performing, sending, processing, displaying, retrieving, transmitting, and so on. As well understood by those skilled in the art, these operations take the form of electrical or magnetic or optical signals capable of being stored, transferred, combined, and otherwise manipulated through electrical components.

Various operations have been described as multiple discrete steps performed in turn in a manner that is most helpful in understanding embodiments of the present invention. However, the order of description should not be construed as to imply that these operations are necessarily performed in the order that they are presented, or even order dependent. Lastly, repeated usage of the phrases "in one embodiment," "in an embodiment," "an alternative embodiment," or "an alternate embodiment" does not necessarily refer to the same embodiment, although it may.

Thus, a method and apparatus for displaying images from a tiled memory has been described. Although the present invention has been described with reference to specific exemplary embodiments, it will be evident to one of ordinary skill in the art that various modifications and changes may be made to these embodiments without departing from the broader spirit and scope the invention as set forth in the claims. Accordingly, the specification and drawings are to be regarded in an illustrative rather than a restrictive sense.

What is claimed is:

1. A method for displaying images, the method comprising:

retrieving a plurality of pixel attributes from memory in a single memory transaction, wherein an attribute of said plurality of attributes corresponds to a pixel in one scan line of a display and an attribute of said plurality of attributes corresponds to a pixel in another scan line of the display;

displaying a portion of one scan line using the corresponding pixel attribute; and storing the pixel attribute corresponding to another scan line in a buffer.

2. The method of claim 1, further comprising:

retrieving a plurality of additional attributes from memory in a single memory transaction, wherein an attribute of said plurality of additional attributes corresponds to one scan line of the display and an attribute of said plurality of additional attributes corresponds to another scan line of the display.

3. The method of claim 2, further comprising:

displaying another portion of one scan line using the corresponding pixel attribute of said plurality of additional attributes.

4. The method of claim 2, further comprising:

storing the pixel attribute of said plurality of additional attributes corresponding to another scan line in the buffer.

5. The method of claim 4, further comprising:

retrieving the stored pixel attributes from the buffer.

6. The method as recited in claim 5, further comprising:

displaying another scan line based on the pixel attributes retrieved from the buffer.

7. The method of claim 1, further comprising organizing the plurality of pixel attributes in memory as vertical tiles.

8. The method of claim 7, wherein the displaying comprises:

horizontally scanning one scan line to display the portion of the one scan line.

9. The method of claim 1, further comprising organizing the plurality of pixel attributes in memory as horizontal tiles.

10. The method of claim 9, wherein the displaying comprises:

vertically scanning one scan line to display the portion of the one scan line.

11. Apparatus for displaying images, the apparatus comprising:

a memory to store pixel attribute information;

a buffer to store pixel attribute information of a next scan line; and a display engine, wherein in a single memory transaction the display engine to retrieve pixel attribute information from the memory, display at least a portion of one scan line using attribute information of the one scan line and store attribute information of the next scan line in the buffer.

12. The apparatus of claim 11, wherein the display engine retrieves the attribute information stored in the buffer.

13. The apparatus of claim 12, wherein the display engine displays at least a portion of the next scan line using the attribute information stored in the buffer.

14. The apparatus of claim 13, wherein the memory is vertically tiled.

15. The apparatus of claim 14, wherein the display engine uses horizontal scanning to display scan lines.

16. The apparatus of claim 13, wherein the memory is horizontally tiled.

17. The apparatus of claim 16, wherein the display engine uses vertical scanning to display scan lines.

18. The apparatus of claim 11, wherein the memory is to store pixel attribute information of one scan line and pixel attribute information of another scan line in consecutive memory locations.

19. A scan line driving method, comprising:

retrieving attribute information of each pixel in a first scan line and an attribute information of a pixel in another scan line from a memory in a memory transaction; and storing the attribute information of a pixel in the another scan line until the first scan line is displayed.

20. The scan line driving method of claim 19, comprising:

displaying the first scan line based on the retrieved attribute information.

21. The scan line driving method of claim 19, comprising:

retrieving attribute information of the pixel in the another scan line if the first scan line is displayed.

22. The scan line driving method of claim 21, comprising:

displaying the another scan line based on retrieved attribute information of the pixel in the another scan line.

23. A graphics system, comprising:

a memory populated by a plurality of storage entries having a length sufficient to store image attribute information of a plurality of pixels, said storage entries located in consecutive memory locations; and a graphics processor coupled to the memory, the graphics processor comprising a display engine and a scan line buffer, the display engine to retrieve from memory those storage entries associated with a current scan line and storage entries associated with other than the current scan line in a single memory transaction, the scan line buffer adapted to store image attribute information retrieved by the display engine and associated with scan lines other than the current scan line.

24. The graphics system of claim 23, the display engine to further retrieve from the scan line buffer memory image attribute information associated with scan lines other than the current scan line.

25. The graphics system of claim 24, the display engine to display a scan line other than the current scan line based on the retrieved image attribute information.

26. The graphics system of claim 23, the display engine to display the current scan line based on image attribute information associated with the current scan line.

27. The graphics system of claim 23, wherein the storage entries are organized as vertical tiles in memory.

28. The graphics system of claim 27, wherein the display engine uses horizontal scanning to display scan lines.

29. The graphics system of claim 23, wherein the storage entries are organized as horizontal tiles in memory.

* * * * *

UNITED STATES PATENT AND TRADEMARK OFFICE

CERTIFICATE OF CORRECTION

PATENT NO. : 6,646,647 B1 
DATED : November 11, 2003
INVENTOR(S) : Roman Surgutchik et al.

It is certified that error appears in the above-identified patent and that said Letters Patent is hereby corrected as shown below:

Title page,
Item [75], Inventors, "Shaeffer" should be -- Sheaffer --.

Signed and Sealed this

Seventeenth Day of August, 2004

JON W. DUDAS
*Acting Director of the United States Patent and Trademark Office*